US005289984A

United States Patent [19]

Sohma

[11] Patent Number: 5,289,984

[45] Date of Patent: Mar. 1, 1994

[54] PAPER ROLL DRIVING APPARATUS

[75] Inventor: Isao Sohma, Yokohama, Japan

[73] Assignee: Tokyo Kikai Seisakusho, Ltd., Tokyo, Japan

[21] Appl. No.: 974,351

[22] Filed: Nov. 10, 1992

Related U.S. Application Data

[63] Continuation of Ser. No. 718,178, Jun. 20, 1991, abandoned.

[30] Foreign Application Priority Data

Aug. 17, 1990 [JP] Japan ..... 2-215768

[51] Int. Cl.[5] ..... B65H 19/16

[52] U.S. Cl. ..... 242/58.3

[58] Field of Search ..... 242/55, 58, 58.1, 58.2, 242/58.3, 58.4

[56] References Cited

U.S. PATENT DOCUMENTS 2,216,286 10/1940 Wood ..... 242/58.3

3,460,775 8/1969 Ford et al. ..... 242/58.3

FOREIGN PATENT DOCUMENTS 33-19602 12/1958 Japan .

48-73002 of 1973 Japan .

63-48785 9/1988 Japan .

2-8920 3/1990 Japan .

OTHER PUBLICATIONS

Newspaper Printing (Printing Volume) Revised Edition pp. 74–75 by Japan Newspaper Association, Foundation, 1980.

*Primary Examiner*—Stanley N. Gilreath

*Attorney, Agent, or Firm*—Armstrong, Westerman, Hattori, McLeland & Naughton

[57] ABSTRACT

Disclosed is a paper roll driving apparatus which comprises a timing belt pulley fitted to a rotatable holding member for holding a paper roll core, a timing belt disposed in such a manner as to be selectively displaceable into an engagement/disengagement state with and from the timing belt pulley and belt driving means for driving and moving the timing belt in engagement. The holding member or in other words, the paper roll, is driven for rotation by driving of the timing belt.

5 Claims, 5 Drawing Sheets

PAPER ROLL DRIVING APPARATUS

This application is a continuation of application Ser. No. 07/718,178 filed Jun. 20, 1991, now abandoned.

BACKGROUND OF THE INVENTION

1. Field of the Invention

The present invention relates to a paper roll driving apparatus. More particularly, in a web feeder of a rotary press using a paper roll, the present invention relates to a paper roll driving apparatus for rotating and driving a next paper roll when a paper roll is spliced with a next paper roll.

2. Description of the Prior Art

During splicing in a web feeder of a rotary press using a paper roll, it is generally necessary that the travelling speed of a travelling web paper pulled out in advance from a paper roll be equal to the peripheral speed of a next paper roll. Therefore, a paper roll driving apparatus for rotating and driving a next paper roll is disposed in the web feeder.

Paper roll driving apparatus of this kind are known from "Pre-Drive" in "Newspaper Printing, Printing Edition, Revised Edition", pp. 74–75, (issued on Oct. 31, 1980, by Japan Newspaper Association, Foundation), Japanese Utility Model Publication No. 19602/1958, Japanese Utility Model Laid-Open No. 73002/1973, Japanese Patent Publication No. 48785/1988 and Japanese Utility Model Publication No. 8920/1990.

In the prior art apparatuses disclosed in "Newspaper Printing, Printing Edition, Revised Edition" (issued on Oct. 31, 1980, by Japan Newspaper Association, Foundation), pp. 74–75 and in Japanese Utility Model Publication No. 19602/1958, a driving endless belt or a driving wheel which can come into contact with, and can come out contact from, the outer peripheral surface of a next paper roll and is interconnected to driving means is brought into pressure contact with the outer peripheral surface of the next paper roll and is rotated under such a state, so that the paper roll is driven directly for rotation.

In the apparatus disclosed in Japanese Utility Model Laid-Open No. 73002/1973, a friction wheel is disposed on the support shaft of a paper roll and a driving roller or driving belt which can come into pressure contact with the friction wheel and is interconnected to driving means is brought into pressure contact with the friction wheel disposed on the support shaft to the paper roll and is driven for rotation under such a state, so that the paper roll is driven and rotated through the support shaft.

In the apparatus disclosed in Japanese Patent Publication No. 48785/1988 and Japanese Utility Model Publication No. 8920/1990, a gear is disposed on the support shaft of a paper roll and a driving gear is further disposed which can mesh with the gear and is interconnected to driving means. The driving gear is driven and rotated while it is engaged with the gear disposed on the support shaft of the paper roll and the paper roll is driven and rotated through the support shaft.

Each of the prior art apparatuses described above is not free from the following drawbacks.

In the apparatuses of "Newspaper Printing, Printing Edition, Revised Edition" (issued on Oct. 31, 1980, by Japan Newspaper Association, Foundation), pp. 74–75 and in Japanese Utility Model Publication No. 19602/1988, the driving endless belt or driving wheel is pushed to the outer peripheral surface of the paper roll. Therefore, it is not possible to apply an adhesive for splicing to that end of paper roll corresponding to the pushed portion and bonding power at the time of splicing drops. Since slip occurs between the driving endless belt or driving wheel and the outer peripheral surface of the paper roll, a stable peripheral speed of the paper roll cannot be obtained and the outer peripheral surface of the paper roll might be damaged.

In the apparatus disclosed in Japanese Utility Model No. 73002/1973, slip occurs between the friction wheel and the driving roller or driving belt and a stable peripheral speed of the paper roll cannot be obtained. The friction wheel, the driving roller and the driving belt are worn out during their use for a long period and transmission of the driving force at a set peripheral speed cannot be made.

In the apparatuses disclosed in Japanese Patent Publication No. 48785/1988 and Japanese Utility Model Publication No. 8920/1990, the center distance must be kept accurate when the gear disposed on the support shaft of the paper roll and the driving gear are engaged with each other. Therefore, a special gear equipped with a cylindrical portion becomes necessary and the cost of the apparatus becomes high. Furthermore, this cylindrical portion is worn out in the course of its use for a long period, so that the set center distance cannot be maintained and the gears might be damaged. The rotation of the gears while they are engaged generates noise and deteriorates working environments.

SUMMARY OF THE INVENTION

The present invention contemplates to provide an apparatus which eliminates the problems with the prior art apparatuses described above.

A paper roll driving apparatus in accordance with the present invention includes a timing belt pulley fitted to a rotatable holding member for holding the core of a paper roll, a timing belt disposed in such a manner as to be selectively displaceable into an engagement/disengagement state with and from the timing belt and belt driving means for driving and moving the timing belt.

The timing belt in a stand-by position where the timing belt is in a disengagement state from the timing belt pulley fitted to the rotatable holding member for holding the core of the paper roll undergoes displacement and is engaged with the timing belt pulley. The timing belt thus engaged is rotated by the belt driving means, so that the paper roll is driven for rotation through the timing belt pulley and the holding member.

BRIEF DESCRIPTION OF THE DRAWINGS

Other objects, features and advantages of the present invention will be described in the following with reference to the accompanying drawings, in which.

DESCRIPTION OF THE PREFERRED EMBODIMENTS

Figure 2:
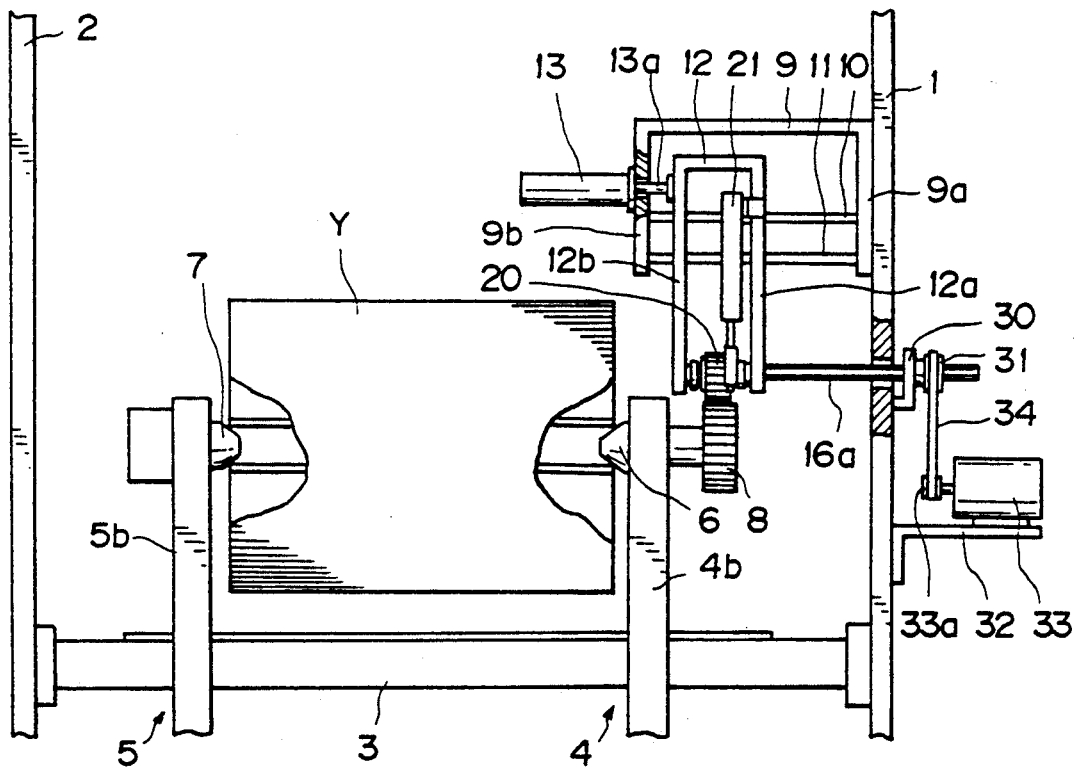
FIG. 2 is a partial sectional side view showing the schematic structure of the paper roll driving apparatus in the first embodiment of the present invention.
Figure 3:
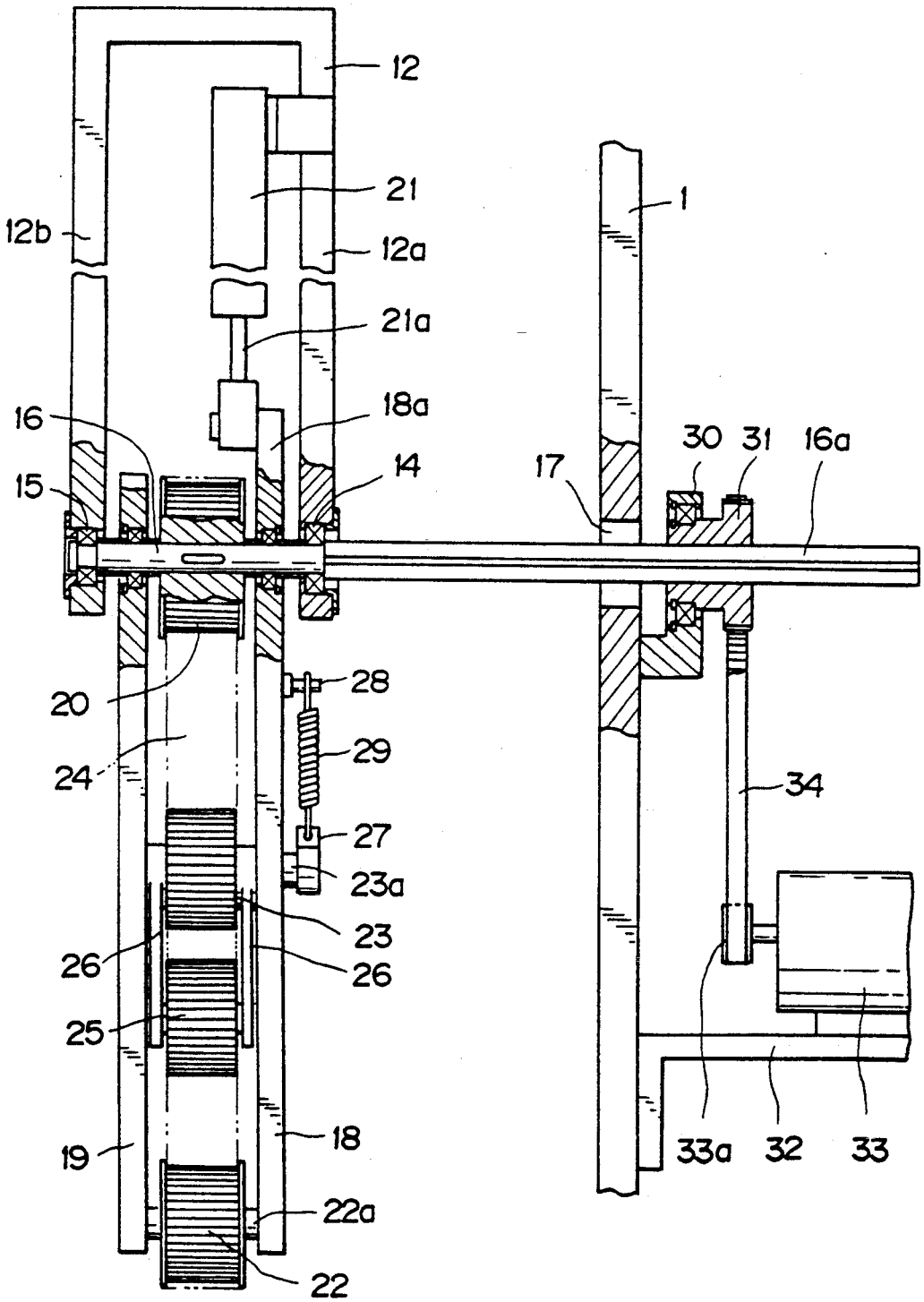
FIG. 3 is a partial sectional side view of double faced timing belt driving means of the paper roll driving apparatus in the first embodiment of the present invention.

A paper roll driving apparatus in accordance with preferred embodiments of the present invention will be explained with reference to FIGS. 1, 2 and 3.

In a paper roll driving apparatus of a web feeder of a rotary press using a paper roll, a machine frame 1 and a machine frame 2 are disposed vertically in parallel with each other so as to face each other and both ends of a spider shaft 3 crossing orthogonally these machine frames 1, 2 are supported rotatably by bearings. The spider shaft 3 is allowed to move in an axial direction by a moving mechanism not shown in the drawings.

Spiders 4 and 5 are key-coupled to the spider shaft 3 in such a manner as to face each other with a spacing between them in an axial direction and opposed arms 4*a*, 5*a* and 4*b*, 5*b* of these arms 4, 5 are in parallel with one another. Center collars 6, 7 as holding members of the paper roll are supported rotatably round an axis which is in parallel with the axis of the spider shaft 3 at each arm end of the arms 4, 5 and when both ends of a core of the paper roll are clamped between and supported by the center collars 6, 7, the paper roll is supported rotatably by these arms 4, 5. A timing belt pulley 8 meshing with a double faced timing belt of belt driving means, which will be described later, is fixed to the outer end portion of the center collar 6 on the side of the machine frame 1.

The belt driving means will be explained next. A downwardly U-shape sub-frame 9 equipped with side frames 9*a*, 9*b* with a spacing between them in the axial direction of the spider shaft 3 is disposed on the inner side surface of the machine frame 1 above the spider shaft 3 and mutually parallel guide bars 10, 11 which are in parallel with the spider shaft 3 are disposed between both side frames 9*a*, 9*b*. An inverted U-shape arm 12 equipped with support arms 12*a*, 12*b* having a spacing between them in the axial direction of the spider shaft 3 is supported in such a manner that it can slide while being guided by the guide bars 10, 11 when the guide bars 10, 11 are inserted through its slide holes. A piston rod 13*a* of a fluid cylinder 13, which is fitted to one 9*b* of the side frames of the sub-frame 9, is coupled to the inverted U-shape arm 12.

Detailed explanation will be given further with reference to FIG. 3. A rotary shaft 16 is supported rotatably by bearings 14, 15 at the lower end portions of the support arms 12*a*, 12*b* of the inverted U-shape arm 12 and extends and protrudes outward from the support arm 12*a* on the side of the machine frame 1, and its extension portion serves as a spline shaft portion 16*a*, and protrudes further outside the machine frame 1 via a through-hole 17 in machine frame 1.

Base end portions of two bent arms 18, 19 are supported rotatably by bearings on the rotary shaft 16 between both support arm portions 12*a*, 12*b* of the inverted U-shape arm 12 with a spacing between them in the direction of the axis of rotation and a timing belt pulley 20 is key-coupled to the rotary shaft 16 while being interposed between the bent arms 18, 19. The base end portion of one 18 of the bent arms becomes an extension portion 18*a* and is fitted pivotally to the tip of the piston rod 21*a* of the fluid cylinder 21 that is mounted to the support arm portion 12*a* of the inverted U-shape arm 12.

A shaft 22*a* and a rotatable shaft 23*a* are disposed at the tips and bent projection portions of the bent arms 18, 19 between them and timing belt pulleys 22, 23 are supported rotatably by these shafts, respectively. A double faced timing belt 24 is passed around these timing belt pulleys 20, 22, 23. The base portion of each of the rocking arms 26, 26, which support rotatably a timing belt tension pulley 25 at their tips, is fixed to the shaft 23*a* and an extension coil spring 29 is stretched between a hook 27 implanted to the outer peripheral surface at the projection end of the shaft 23*a* and a pin 28 implanted to the bent arm 18. The force of this spring 29 biases always and clockwise the rocking arms 26, 26 in FIG. 1 and the tension pulley 25 engages with the surfaces of the double faced timing belt 24.

A timing belt pulley 31 is supported rotatably by a bracket 30 which is fitted to the machine frame 1 and the center hole of this pulley 31 is spline-coupled to the spline shaft portion 16*a* of the rotary shaft 16. A timing belt 34 is passed around the timing belt pulley 31 and a timing belt pulley 33*a* fitted to the motor shaft of a motor 33 which is fitted to a bracket 32 which is mounted to the machine frame 1.

On the other hand, the feeder apparatus is provided with a known splicing apparatus which includes a brush 40 for pushing the paper web P which is pulled out from the paper roll X fitted to the opposed arms (4*a*, 5*b* in FIG. 1) of the spiders 4, 5 and is travelling, to the peripheral surface of the next paper roll Y fitted to the adjacent opposed arms (4*b*, 5*b* in FIG. 1), a cutter 41 operating in such a manner as to cut off the paper web P immediately upstream of the brush 40, a paster arm 43 equipped with a guide member 42 for guiding the paper web P upstream of the brush 40 and having one of its ends fitted pivotally to the machine frame, and a fluid cylinder 44 fitted pivotally to the machine frame, having its piston rod fitted pivotally to the paster arm 43 and causing rotation and displacement of the paster arm 43. The end of the next paper roll Y is bonded tentatively to its outer peripheral surface lest it should come loose due to its rotation, and pasting treatment is applied to the surface of the paper end so that it is bonded to the paper web P at the time of pasting.

Figure 4:
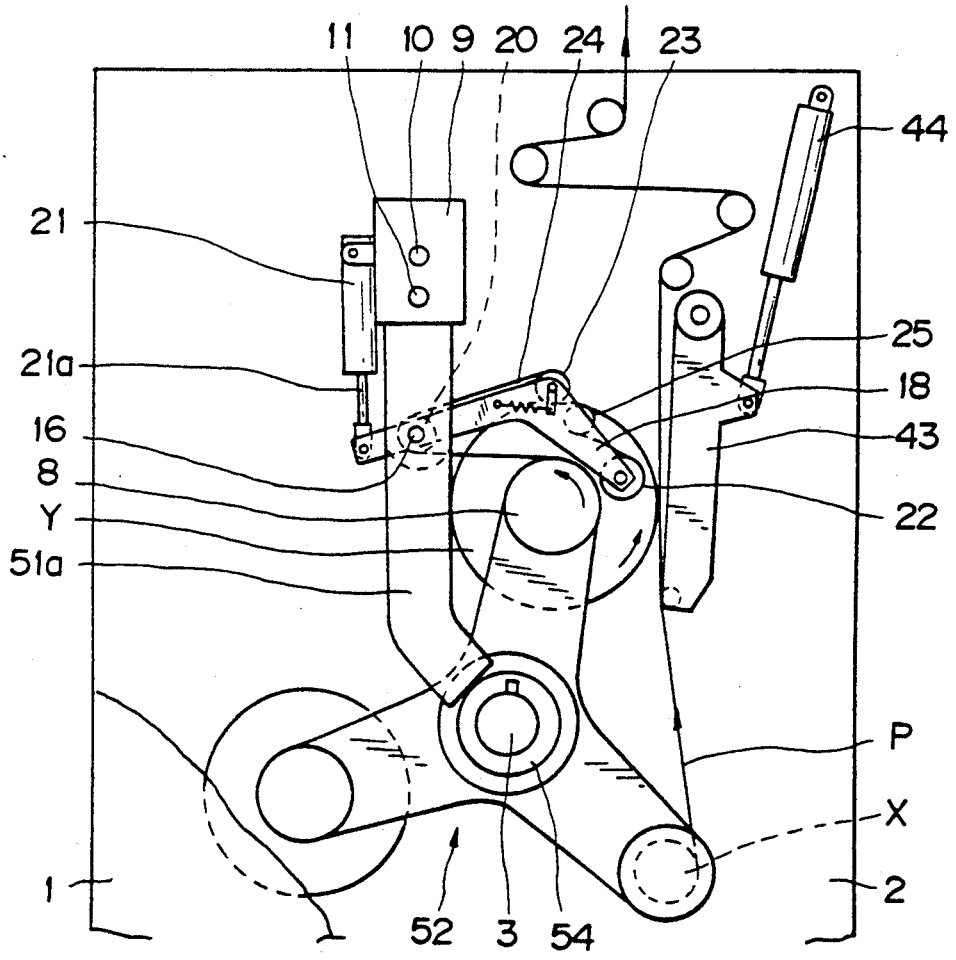
FIG. 4 is a front view showing the schematic structure of the paper roll driving apparatus in accordance with a second embodiment of the present invention.
Figure 5:
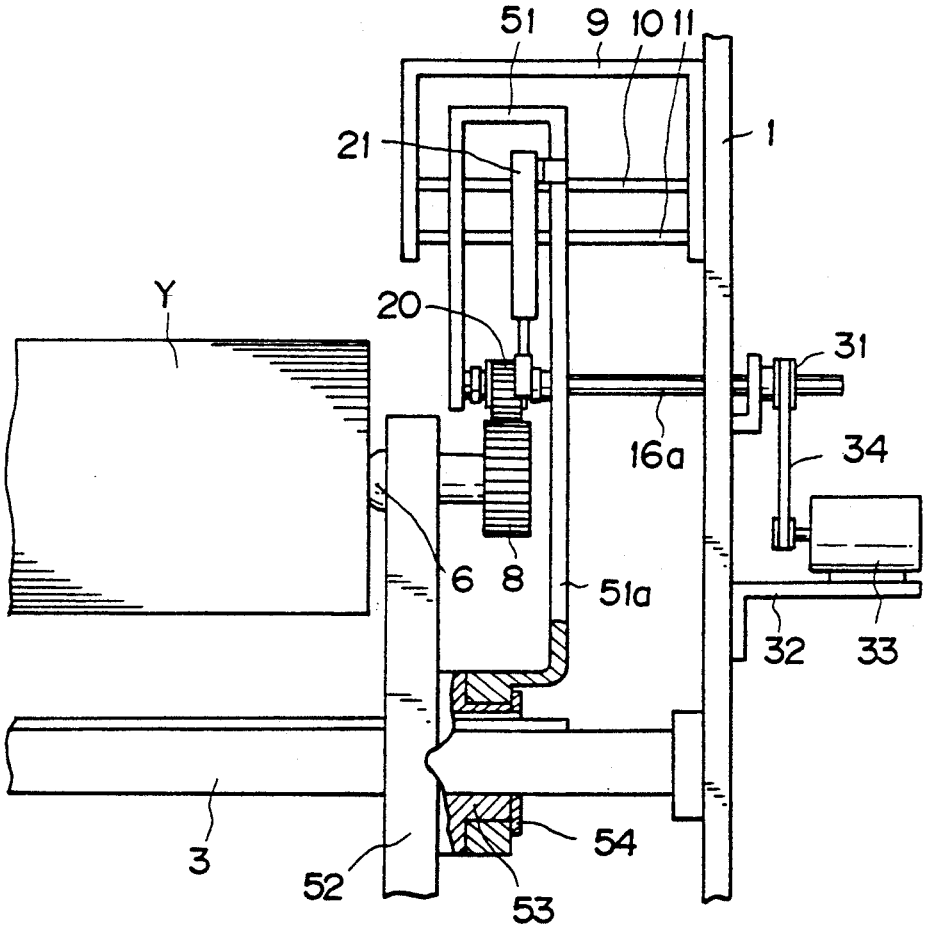
FIG. 5 is a partial sectional side view showing the schematic structure of the paper roll driving apparatus in accordance with the second embodiment of the present invention.

The paper roll driving apparatus in accordance with the second embodiment of the present invention will be explained with reference to FIGS. 4 and 5.

In the paper roll driving apparatus of the second embodiment, one of the support portions 51*a* of the inverted U-shape arm 51 is extended and a boss 53 of the spider 52 is loosely fitted into the through-hole that is formed in the end of the extension portion. A retaining ring 54 fixed to the end surface of the boss 53 restricts the displacement in the axial direction. This system is not provided with the fluid cylinder 13 of the first embodiment.

The operation and function of the paper roll driving apparatus are as follows and the splicing of the paper roll and the next paper roll in the feeding apparatus is carried out in the following way.

Figure 1:
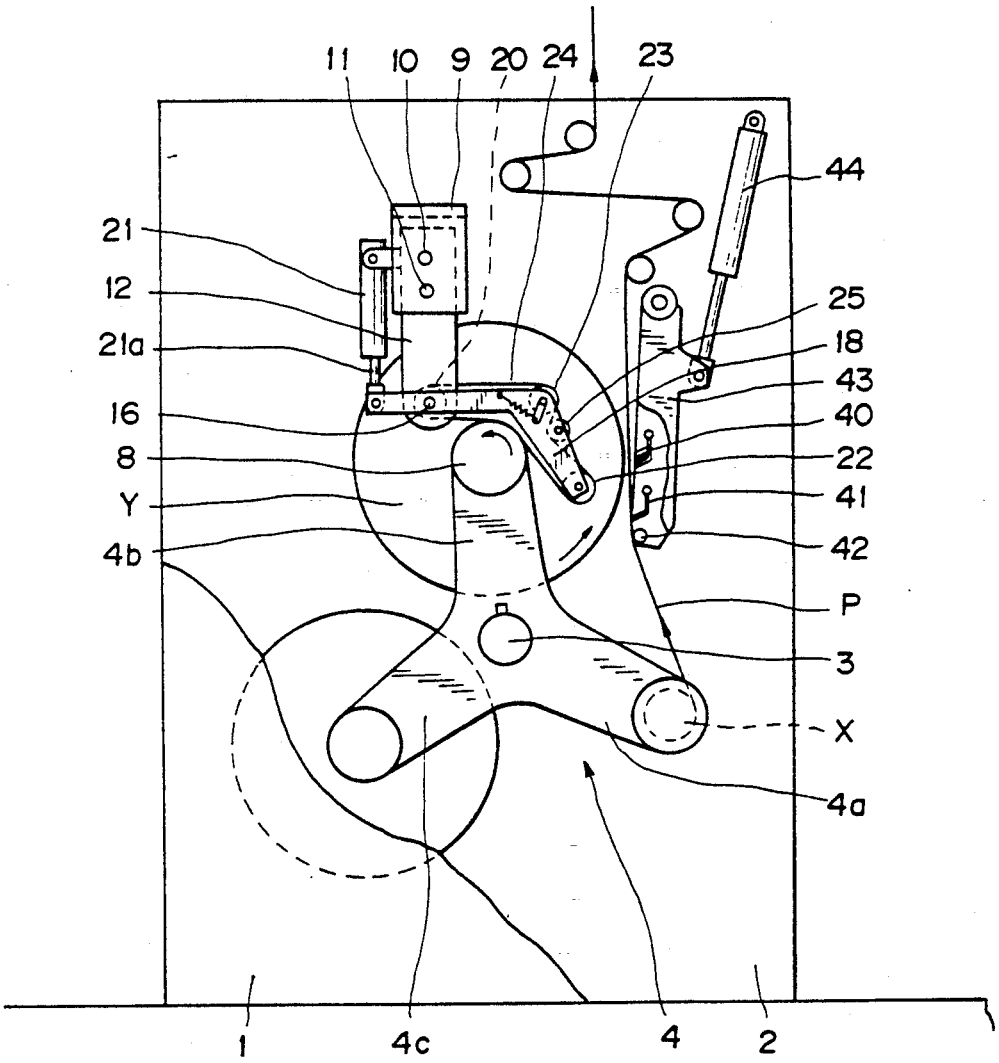
FIG. 1 is a front view showing the schematic structure of a paper roll driving apparatus in a first embodiment of the present invention.

In FIG. 1, the paper web P is routed and travels to a printing unit (not shown) downstream of the feeder apparatus. When a sensor (not shown) detects the reduction of the diameter of the paper roll X to a predetermined first roll diameter, its detection signal operates the fluid cylinder 44, the piston rod extends and the paster arm 43 rotates clockwise in FIG. 1. The paper web P is stretched to near the outer peripheral surface of the next paper roll Y by the guide member 42 and at the same time, the fluid cylinder 21 operates. When the piston 21*a* moves back and retracts, the bent arm 18 rotates clockwise with the rotary shaft 16 being the axis in FIG. 1. Then, the double faced timing belt 24 engages with the timing belt pulley 8 of the center collar 6 of the opposed arm 4*b* to which the next paper roll Y is fitted. This engagement is effected at any position between the timing belt pulley 20 of the double faced timing belt 24 and the timing belt pulley 22. Accordingly, since the double faced timing belt 24 can engage with the timing belt pulley 8 irrespective of the rotation phase of the spiders 4, 5 or in other words, irrespective of the diameter of the next paper roll Y, the following splicing is carried out.

When the motor 33 is actuated, the next paper roll Y is rotated counter-clockwise in FIG. 1 through the timing belt pulley 33*a*, the timing belt 34, the timing belt pulley 31, the rotary shaft 16, the timing belt pulley 20, the double faced timing belt 24, the timing belt pulley 8 and the center collar 6 and is sped up until its peripheral speed reaches the travelling speed of the paper web P.

Subsequently, when the diameter of the paper roll X decreases to a preset second roll diameter and the sensor (not shown) detects this state, its detection signal actuates the brush 40, so that the paper web P from the paper roll X is pushed to the outer peripheral surface of the next paper roll Y and is bonded to the end of the next paper roll Y. Furthermore, the cutter 41 operates and cuts the web paper P from the paper roll X on the upstream side of the bonding position. In this manner, the splicing is completed and the paper web P is supplied from the next paper roll Y.

After the splicing is completed, the fluid cylinder 21 operates reversely and the piston rods 21*a* extends, so that the bent arm 18 rotates counter-clockwise with the rotary shaft 16 being the axis in FIG. 1. Then, the double faced timing belt 24 disengages from the timing belt pulley 8 of the center collar 6 of the opposed arm 4*b* that mounts the next paper roll Y and moves back to the stand-by position and at the same time, the motor 33 stops, too.

The fluid cylinder 44 operates reversely, too, and the piston rod retracts. Accordingly, the paster arm 43 rotates counter-clockwise in FIG. 1 and moves back to its stand-by position.

Since the spider shaft 3 is rotated clockwise by the driving unit (not shown) in FIG. 1, the spiders 4, 5 rotate and the next paper roll Y moves round and when the next paper roll Y reaches a predetermined position, the driving unit stops the spider shaft 3.

When the width of the paper roll is changed to obtain desired printing or when the travelling position of the web paper P is somewhat changed in conjunction with the printing unit (not shown) on its downstream side, the spiders 4, 5 are moved in the axial direction of the spider shaft 3 by a moving mechanism not shown in the drawings. In this case, the timing belt pulley 8 moves with the center collar 6 that moves with the spider 4. The position of the double faced timing belt 24 is aligned with that of the timing belt pulley 8 in order to keep the positional relation between the double faced timing belt 24 and the timing belt pulley 8 in the moving direction of the spider 4.

The position adjustment of the double faced timing belt 24 is effected by detecting the moving position of the spider 4, 5 and timing belt pulley 8 by the sensor (not shown), operating the fluid cylinder 13 by a controller (not shoen) on the basis of its detection signal and moving the inverted U-shape arm 12 by a predetermined distance along the guide rods 10, 11. Then, the double faced timing belt 24 undergoes displacement by the same distance in the axial direction of the spider shaft 3 through the bent arms 18, 19 and through the timing belt pulleys 20, 22, 23. In this manner, the position of the double faced timing belt 24 is in agreement with the position of the timing belt pulley 8.

The position adjustment of the double faced timing belt 24 may be carried out by an operation mechanism which is operated manually by an operator, without using the mechanism comprising the sensor, the controller and the fluid cylinder.

In the second embodiment (FIGS. 4 and 5), the inverted U-shape arm 51 is coupled to the spider 52 in the axial direction. Therefore, the movement of the spider 52 causes the identical movement of the inverted U-shape arm 51 or in other word, the identical movement of the double faced timing belt 24. Consequently, the position relation between the timing belt pulley 8 and the double faced timing belt 24 is kept unaltered. For this reason, the position adjustment means for the double faced timing belt that is used in the first embodiment is not necessary.

In the paper roll driving apparatus in accordance with the present invention, transmission of the rotation driving force is made by the engagement between the timing belt and the timing belt pulley and no slip occurs during this rotation driving transmission. Therefore, rotation can be transmitted accurately, so that the peripheral speed of the next paper roll is stabilized and an accurate splicing can be carried out.

The center distance need not be maintained accurately to secure the engagement between the timing belt and the timing belt pulley as has been necessary in the case of the mutual engagement of gears. Therefore, possible damage to teeth does not occur.

Furthermore, in the transmission of the rotation driving force by the engagement between the timing belt and the timing belt pulley, noise can be reduced and the operation environment can be improved. Accordingly, mental burden to the operator can be reduced and work efficiency can be improved.

I claim:

1. A paper roll driving apparatus, comprising:

a rotatable holding member for holding a core of a paper roll;

a timing belt pulley fitted to said rotatable holding member for rotation with said holding member and a core of a paper roll held thereon;

an arm having a plurality of belt pulleys supported thereon;

said arm being pivotally connected at a pivot point to a support portion of the apparatus;

a timing belt supported on said plurality of belt pulleys so as to be pivotally mounted for selective displacement into and out of engagement with said timing belt pulley;

means for driving said timing belt;

means for pivoting said arm around said pivot point for pivotally moving said timing belt into and out of engagement with said timing pulley for driving and interrupting driving of said rotatable holding member and said paper roll, said means for pivoting said arm around said pivot point for pivotally moving said timing belt having a piston rod connected to said arm and a means for extending and retracting said piston rod for moving said timing belt into and out of engagement with said timing pulley;

wherein said support portion of the apparatus includes a sub-frame having a means for movably supporting a second arm thereon, said arm being pivotally connected at said pivot point to said second arm, and a means for moving said second arm along said sub-frame such that said timing belt is moved toward and away from the timing belt pulley; and wherein said means for movably supporting said second arm on said sub-frame includes at least one guide bar and said means for moving said second arm includes a piston and piston rod which are supported proximate said sub-frame, said piston rod being connected to a portion of said second arm so as to move said second arm along said at least one guide bar.

2. The paper roll driving apparatus of claim 1, wherein said piston rod for pivoting said arm is connected to said arm on an opposite side of said pivot point than at least one of said belt pulleys.

3. The paper roll driving apparatus of claim 2, wherein said arm is a bent arm having a generally v-shape, and wherein said timing belt pulley contacts said timing belt when in engagement therewith at a location along the bent arm adjacent to the bent portion thereof such that the bent arm extends around a perimeter portion of the timing belt pulley.

4. The paper roll driving apparatus of claim 2, wherein said rotatable holding member is supported on a spider member having three outwardly extending arms which rotate about a central shaft.

5. The paper roll driving apparatus of claim 2, wherein said arm is pivotally supported at a location above said timing pulley so that the weight of said arm facilitates engagement between said timing belt and said timing belt pulley.

* * * * *